US008986578B2

(12) United States Patent
Basheer

(10) Patent No.: US 8,986,578 B2
(45) Date of Patent: Mar. 24, 2015

(54) HIGH IMPACT STRENGTH CONDUCTIVE ADHESIVES

(75) Inventor: Rafil A. Basheer, Rochester Hills, MI (US)

(73) Assignee: King Fahd University of Petroleum and Minerals, Dhahran (SA)

( * ) Notice: Subject to any disclaimer, the term of this patent is extended or adjusted under 35 U.S.C. 154(b) by 637 days.

(21) Appl. No.: 13/339,359

(22) Filed: Dec. 28, 2011

(65) Prior Publication Data

US 2013/0168613 A1 Jul. 4, 2013

(51) Int. Cl.
*H01B 1/02* (2006.01)
*H01B 1/22* (2006.01)

(52) U.S. Cl.
CPC ..... *H01B 1/22* (2013.01)
USPC ..... 252/514

(58) Field of Classification Search
None
See application file for complete search history.

(56) References Cited

U.S. PATENT DOCUMENTS

| | | | | |
|---|---|---|---|---|
| 5,300,584 | A | 4/1994 | Farkas | |
| 5,891,367 | A | 4/1999 | Basheer et al. | |
| 6,410,615 | B1 | 6/2002 | Taniguchi et al. | |
| 6,670,430 | B1 | 12/2003 | Konarski | |
| 7,034,404 | B1 | 4/2006 | Harada et al. | |
| 7,087,304 | B1 * | 8/2006 | Woods et al. | 428/414 |
| 7,927,514 | B2 | 4/2011 | Kondo et al. | |
| 2009/0220738 | A1 * | 9/2009 | Oka et al. | 428/137 |
| 2010/0209690 | A1 * | 8/2010 | Sang et al. | 428/221 |

FOREIGN PATENT DOCUMENTS

| | | |
|---|---|---|
| EP | 1 437 394 A1 | 7/2004 |

* cited by examiner

*Primary Examiner* — Harold Pyon
*Assistant Examiner* — Jaison Thomas
(74) *Attorney, Agent, or Firm* — Richard C Litman

(57) ABSTRACT

The high impact strength conductive adhesive is a mixture formed from a bisphenol A-based epoxy resin, a curing agent, and silver flakes. In one embodiment, the bisphenol A-based epoxy resin forms about 10.5 wt % of the mixture and the curing agent forms about 14.5 wt % of the mixture, the balance being silver flakes. In this embodiment, the curing agent is preferably an oligomeric polyamine curing agent, such as amidoamine-polyoxypropylenediamine t-butyl phenol. Each silver flake preferably has a tap density of between about 4.0 $g/cm^3$ and about 5.8 $g/cm^3$, and a surface area of between about 0.8 $m^2/g$ and about 0.3 $m^2/g$. In an alternative embodiment, the bisphenol A-based epoxy resin forms about 11.7 wt % of the mixture and the curing agent forms about 16.3 wt % of the mixture, the balance being silver flakes.

4 Claims, No Drawings

HIGH IMPACT STRENGTH CONDUCTIVE ADHESIVES

BACKGROUND OF THE INVENTION

1. Field of the Invention

The present invention relates to electrically conductive epoxy adhesives that may be used in lieu of solder in electrical applications, especially circuit board packaging applications, and particularly to high impact strength conductive adhesives having stable electrical properties.

2. Description of the Related Art

Production of electronic modules typically involves an electrical circuit patterned on a fiberglass/epoxy, ceramic, or flexible polymer substrate with copper conductors, typically referred to as a printed circuit board. The electrical functions are imparted through circuit components (i.e., transistors, resistors, capacitors, diodes, microprocessors, etc.), which are soldered to the surface of the board or soldered in holes through the board. Constructions of this sort are widely used in many industries. The leading technique used throughout the electronics industry for soldering components to the substrate uses a metallic solder alloy containing, by weight, about 63% tin and 37% lead. This is typically applied to the circuit board either as a paste, which is heated to more than 200° C. to reflow the paste into a solder joint, or the board may be passed over a molten wave of solder to form joints to bond the electrical components to the circuit board. In either case, a flux material consisting of weak acids is used to remove surface oxidation from metallic surfaces and allow the molten solder to bond to the surfaces and form reliable solder joints.

While this solder attachment technology has existed for many decades, it does have some notable shortcomings. One issue is the lead contained in the alloy. Lead has already been banned from paint, gasoline, and plumbing solders for environmental and safety reasons. Numerous environmental regulations have been proposed to tax, limit, or ban the use of lead in electronic solders. A second shortcoming is the use of the above mentioned flux material for removing surface oxides. This flux leaves a residue on the finished parts that must be cleaned off with a solvent spray. This is an expensive and often inefficient process.

In addition to lead and flux, the solder needs to be processed at temperatures above 200° C. This temperature often dictates the use of an expensive substrate in order to withstand the soldering process temperature, even though the assembly will never encounter temperatures nearly as high in the rest of its service life. Yet another shortcoming of solder is that the metallic alloy is a brittle material that can crack after repeated thermal cycling. In cases where expansion rates of component and substrate are vastly different, cracked solder joints may be a significant problem.

There are two primary alternatives to the existing tin/lead solders. One is a lead-free metallic solder alloy and the other is an electrically conductive synthetic resin adhesive. In the family of metallic solders, many lead-free alloys exist, such as tin, silver, indium, bismuth, copper and antimony, among other metals. Numerous research efforts have evaluated lead-free alloys, but have found no lead-free solders that directly match the properties of the existing 63% tin/37% lead alloy in use today. Drawbacks of lead-free solders include: higher process temperature (which may require redesigned circuit boards and electrical components), different mechanical properties, longer processing times and more sensitivity to assembly process parameters.

The second alternative, electrically conductive adhesives, offers several advantages over traditional solder assembly, including the absence of lead, low processing temperatures, no need for solder flux or subsequent flux cleaning steps, improved mechanical properties, better high temperature performance, and a simplified assembly process. Conductive adhesives have been on the market for several decades and are widely used in sealed semiconductor packages. However, use of conductive adhesives for unsealed circuit boards represents a new application for adhesives.

Several research efforts have evaluated conductive adhesives as a solder replacement. They have reported successful results for niche applications, but have not identified a drop-in solder replacement. The technology is limited by electrical resistance stability through temperature/humidity aging and impact strength.

In the United States, the National Center for Manufacturing Sciences (NCMS) performed an extensive evaluation of electrically conductive adhesives for surface-mount printed circuit applications. In that cooperative industry project, over 30 commercially available adhesives were evaluated for basic electrical and mechanical properties. The NCMS team defined a test method for evaluating electrical resistance of a conductive adhesive joint, as well as an impact test to assess the capability of these adhesives for holding a component on a circuit board during an impact. The electrical testing was performed before and after exposure to an elevated temperature/humidity environment (85° C., 85% RH), and was conducted with copper parts and tin/lead parts. The testing revealed that some adhesives had adequate electrical resistance when copper surfaces were used. On the other hand, no adhesives were identified for producing adequate resistance with tin/lead surfaces. Impact testing also concluded that no adhesives were capable of meeting the NCMS impact test requirement. The use of present conductive adhesives for surface-mount component attachment to printed circuit boards is very limited because the impact strength and electrical resistance stability that they provide has fallen far short of the industry standard tin/lead solder performance.

Previous testing of commercially available adhesives has concluded that conductive adhesives are suitable for only niche applications, limited by resistance and impact requirements. Contact with commercial adhesive vendors has revealed that most have been stopped by the requirement for resistance stability on Sn/Pb surfaces. Some vendors have claimed success at developing an impact-resistant adhesive, but none have been able to address the resistance variability when in contact with tin/lead layers. In fact, many adhesive vendors have acknowledged that impact strength and resistance stability are mutually exclusive parameters.

From a traditional viewpoint, cured epoxy resins are often thought of as rigid and brittle materials. This rigidity and brittleness are further magnified when fillers are added to accomplish certain desirable properties, such as in the case of metal-filled epoxy resins. Conventional epoxies filled with 70% to 80% silver flakes are highly conductive, but very brittle, and failure occurs even under a mild mechanical shock condition.

Thus, high impact strength conductive adhesives solving the aforementioned problems is desired.

SUMMARY OF THE INVENTION

The high impact strength conductive adhesive is a mixture formed from a bisphenol A-based epoxy resin, a curing agent, and flakes of silver. In a first embodiment, the bisphenol A-based epoxy resin forms about 10.5 wt % of the mixture and the curing agent forms about 14.5 wt % of the mixture, the balance being silver flakes. In this embodiment, the curing agent is preferably an oligomeric polyamine curing agent, such as amidoamine-polyoxypropylenediamine t-butyl phenol, sold under the name Epi-Cure 3164 and distributed by Momentive Specialty Chemicals, Inc. Each silver flake preferably has a tap density of between about 4.0 g/cm$^3$ and about 5.8 g/cm$^3$, and a surface area of between about 0.8 m$^2$/g and about 0.3 m$^2$/g.

In an alternative embodiment, the bisphenol A-based epoxy resin forms about 11.7 wt % of the mixture and the curing agent forms about 16.3 wt % of the mixture, the balance being silver flakes.

In a further alternative embodiment, a secondary epoxy resin is added, so that the bisphenol A-based epoxy resin forms about 8.33 wt % of the mixture, the secondary epoxy resin forms about 8.33 wt % of the mixture, and the curing agent forms about 8.33 wt % of the mixture, the balance being silver flakes. In this embodiment, the curing agent is preferably a 2,4,8,10-tetraoxaspiro(5,5)undecane-3,9-dipropanamine adduct with (butoxymethyl) oxirane, such as that sold under the name YSE-Cure B001, distributed by Ajinomoto® U.S.A., Inc. In this embodiment, each silver flake preferably has a tap density of between about 3.2 g/cm$^3$ and about 5.0 g/cm$^3$, and a surface area of between about 0.4 m$^2$/g and about 0.7 m$^2$/g. In a still further alternative embodiment, the curing agent is preferably a 2,4,8,10-tetraoxaspiro(5,5)undecane-3,9-dipropanamine adduct with 2-propenenitrile, such as that sold under the name YSE-Cure N001, distributed by Ajinomoto® U.S.A., Inc.

These and other features of the present invention will become readily apparent upon further review of the following specification.

DETAILED DESCRIPTION OF THE PREFERRED EMBODIMENTS

The high impact strength conductive adhesive is a mixture formed from a bisphenol A-based epoxy resin, a curing agent, and flakes of silver. In a first embodiment, the bisphenol A-based epoxy resin forms about 10.5 wt % of the mixture and the curing agent forms about 14.5 wt % of the mixture, the balance being silver flakes. In this embodiment, the curing agent is preferably a mixture of an amidoamine made from 2-aminoethylpiperazine and dimer fatty acid, polyoxypropylenediamine and t-butyl phenol, sold under the name Epi-Cure 3164 and distributed by Momentive Specialty Chemicals, Inc. Each silver flake preferably has a tap density of between about 4.0 g/cm$^3$ and about 5.8 g/cm$^3$, and a surface area of between about 0.8 m$^2$/g and about 0.3 m$^2$/g. An example of such silver flakes is SF-26LV silver flakes, manufactured by Evonik Degussa GmbH of Germany. The bisphenol A-based epoxy resin may be any suitable low-chloride resin, such as Epon 1462, distributed by Momentive Specialty Chemicals, Inc.

Epi-Cure 3164 is a commercial proprietary oligomeric polyamine epoxy curing agent that is partly based on amidoamine of 2-aminoethylpiperazine and dimer fatty acid. Analysis of Epi-Cure 3164 shows that it contains a mixture of amidoamine, polyoxypropylene diamine (M.W.=400) and tertiary butyl phenol at approximate weight percentages of 60:25:15, respectively. Tertiary butyl phenol is commonly added to amidoamines to enhance their compatibility with bisphenol A-based epoxy resin. The mixture of Epi-Cure 3164 with the bisphenol A-based epoxy resin produces an ultra-high impact strength conductive adhesive. Table 1 below illustrates the material properties of the composition of this first embodiment (designated formulation C1) with exemplary quantities of Epon 1462, Epi-Cure 3164 and SF-26LV silver flakes:

TABLE 1

| Material properties of formulation C1 | |
|---|---|
| Components | |
| Resin: Epon 1462 | 1.2 (g) |
| Curing agent: Epi-Cure 3164 | 1.656 (g) |
| Silver: SF-26LV | 75 wt % |
| Properties | |
| Impact strength | |
| Impact (drops) | 140* |
| Electrical | |
| Substrate Surface | Resistance (mΩ) |
| Cu (initial) | 0.18 |
| Cu (final) | 0.19 |
| Sn/Pb (initial) | 0.45 |
| Sn/Pb (final) | 1.0 |

*204 at 8.9 mil thick film

The mixture of bisphenol A-based epoxy resin with Epi-Cure 3164 is relatively viscous. This property allows low viscosity (i.e., high density and low surface area) silver flakes to remain suspended in the adhesive composition during curing. Epoxy formulations that have significantly lower viscosities than those containing Epi-Cure 3164 were found to result in silver settling and increased electrical resistance if silver flakes of higher density and lower surface area were employed.

The advantages of using low surface area silver flakes in conductive adhesives originate from a reduced volume fraction of silver-bound adhesive relative to the volume fraction of free adhesive (not associated with the silver). For a constant filler concentration, a higher volume fraction of free adhesive provides for better component adhesion and improved mechanical properties, including impact strength. The high density-low surface area silver flake SF-26LV (with particle sizes of about 1.5-5.0 μm) produces conductive epoxy formulations with ultra-high impact strength properties and good electrical resistance stability after aging, as shown above in Table 1. Impact strength was tested by repeatedly dropping the printed circuit board from a height of 60 inches until the component adhered to the hoard broke free.

Although any suitable type of silver flakes may be used, other high density silver flakes, such as SF-84 (also manufactured by Evonik Degussa GmbH of Germany, with a tap density of 5.5 g/cm$^3$, a low viscosity, and a surface area of 0.2 m$^2$/g) provided only marginal improvement in impact properties over formulations made form silver flakes of lower densities (i.e., with a high surface area). Thus, only silver flakes that are comparable to SF-26LV in density, surface area, shape, size distribution, and surface lubrication are effective in producing ultra-high impact strength and stable electrical resistance values. Higher viscosity silver flakes (lower density and higher surface area) resulted in high viscosity formulations with much lower adhesive impact strength and joint resistance stability. A composition identical to C1 above, but with SF-84 silver flakes instead of SF-26LV silver flakes, yielded an impact measurement of 8 drops, an initial resistance value on a copper surface of 1.9 mΩ, a final resistance value on a copper surface of 2.2 mΩ, an initial resistance value on a tin/lead surface of 1.5 mΩ, and a final resistance value on a tin/lead surface of 3.3 mΩ. Similarly, using SF-80 silver flakes (also manufactured by Evonik Degussa GmbH of Germany, with a tap density of 3.2-5.0 g/cm$^3$, a medium viscosity, and a surface area of 0.4-0.7 m$^2$/g) instead of SF-26LV silver flakes yielded an impact measurement of 5 drops, an initial resistance value on a copper surface of 0.2 mΩ, a final resistance value on a copper surface of 0.1 mΩ, an initial resistance value on a tin/lead surface of 2.0 mΩ, and a final resistance value on a tin/lead surface of 8.0 mΩ. Using SF-69 silver flakes (also manufactured by Evonik Degussa GmbH of Germany, with a tap density of 4.0 g/cm$^3$, a low viscosity, and a surface area of 0.26 m$^2$/g) instead of SF-26LV silver flakes yielded an impact measurement of 22 drops, an initial resistance value on a copper surface of 0.7 mΩ a final resistance value on a copper surface of 0.3 mΩ, an initial resistance value on a tin/lead surface of 6.5 mΩ, and a final resistance value on a tin/lead surface of 7.6 mΩ.

In an alternative embodiment, the bisphenol A-based epoxy resin forms about 11.7 wt % of the mixture and the curing agent forms about 16.3 wt % of the mixture, the balance being silver flakes. Table 2 below illustrates the material properties of the composition of this second embodiment (designated formulation C2) with exemplary quantities of Epon 1462, Epi-Cure 3164 and SF-26LV silver flakes:

TABLE 2

| Material properties of formulation C2 | |
|---|---|
| Components | |
| Resin: Epon 1462 | 1.2 (g) |
| Curing agent: Epi-Cure 3164 | 1.656 (g) |
| Silver: SF-26LV | 72.0 wt % |
| Properties | |
| Impact Strength | |
| Impact (drops) | 156 |
| Electrical | |
| Substrate Surface | Resistance (mΩ) |
| Cu (initial) | 0.22 |
| Cu (final) | 0.24 |
| Sn/Pb (initial) | 0.78 |
| Sn/Pb (final) | 2.0 |

In a further alternative embodiment, a secondary epoxy resin is added, so that the bisphenol A-based epoxy resin forms about 8.33 wt % of the mixture, the secondary epoxy resin forms about 8.33 wt % of the mixture, and the curing agent forms about 8.33 wt % of the mixture, the balance being silver flakes. The pot life of amidoamine-cured conductive adhesives is relatively short (on the order of one hour), even in the presence of diluents. Although such an adhesive can be used as a single component frozen pre-mix, it would be more practical to dispense it as a dual component conductive adhesive. However, the electronic packaging industry favors a single component product over a longer pot life conductive adhesive with two components. Composition C3 is a conductive epoxy formulation having a longer pot life (about four hours) with excellent impact properties and electrical resistance stability.

In such adhesives, flexibility is imparted to the material through the resin side of the formulation. Thus, a typical bisphenol A-based epoxy resin with a low hydrolyzable chloride content (such as Epon 1462, as in the previous embodiments) is blended with a highly flexible polyglycol diepoxide (i.e., the secondary epoxy resin). One such second epoxy resin is manufactured under the name DER 732 by the Dow® Chemical Company. DER 732 is an aliphatic epoxy resin, which is compatible with a bisphenol A-based epoxy resin at all, proportions and, upon curing, becomes an integral part of the cured resin. It should be noted that polyglycol diepoxide commercial flexibilizers typically contain a high concentration of hydrolyzable chloride, which can corrode the metal contact in packaged components. Thus, it was necessary to remove as much of the chloride as possible by treating it with sodium hydroxide in an organic solvent with heating.

Curing of this epoxy resin blend may be affected with a variety of amine curing agents. The choice of the proper amine curing agent is determined by its structural flexibility and by its low reactivity at room temperature (i.e., a long pot life). Curing agents with rigid structures or curing agents that simply promote epoxy homopolymerization do not provide sufficiently flexible cured resin to pass the drop-resistance requirements. Experimental results have shown that spiroacetal diamine-based curing agents are sufficiently flexible to form elastomeric adhesives with the above epoxy mixture. However, due to high reactivity, only adducts of these diamines may be used.

In this embodiment, the curing agent is preferably a 2,4,8,10-tetraoxaspiro(5,5)undecane-3,9-dipropanamine adduct with (butoxymethyl) oxirane, such as that sold under the name YSE-Cure B001, distributed by Ajinomoto® U.S.A., Inc. In this embodiment, each silver flake preferably has a tap density of between about 3.2 g/cm$^3$ and about 5.0 g/cm$^3$, and a surface area of between about 0.4 m$^2$/g and about 0.7 m$^2$/g, such as the SF-80 silver flakes manufactured by Evonik Degussa GmbH of Germany, as described above. Table 3 below illustrates the material properties of the composition of this third embodiment (designated as formulation C3) with exemplary quantities of Epon 1462, DER 732, YSE-Cure B001 and SF-80 silver flakes:

TABLE 3

| Material properties of formulation C3 | |
|---|---|
| Components | |
| Resin: Epon 1462 | 1.0 (g) |
| Co-resin: DER 732 | 1.0 (g) |
| Curing agent: YSE-Cure B001 | 1.0 (g) |
| Silver: SF-80 | 75.0 wt % |
| Properties | |
| Impact Strength | |
| Impact (drops) | 25 |
| Electrical | |
| Substrate Surface | Resistance (mΩ) |
| Cu (initial) | 0.24 |
| Cu (final) | 1.4 |
| Sn/Pb (initial) | 2.5 |
| Sn/Pb (final) | 3.0 |

In a still further alternative embodiment, the curing agent is preferably a 2,4,8,10-tetraoxaspiro(5,5)undecane-3,9-dipropanamine adduct with 2-propenenitrile, such as that sold under the name YSE-Cure N001, also distributed by Ajinomoto® U.S.A., Inc. Table 4 below illustrates the material properties of the composition of this fourth embodiment (designated as formulation C4) with exemplary quantities of Epon 1462, DER 732, YSE-Cure N001 and SF-80 silver flakes:

TABLE 4

| Material properties of formulation C4 | |
|---|---|
| Components | |
| Resin: Epon 1462 | 1.0 (g) |
| Co-resin: DER 732 | 1.0 (g) |
| Curing agent: YSE-Cure N001 | 1.0 (g) |
| Silver: SF-80 | 75.0 wt % |
| Properties | |
| Impact Strength | |
| Impact (drops) | 36 |
| Electrical | |
| Substrate Surface | Resistance (mΩ) |
| Cu (initial) | 0.13 |
| Cu (final) | 0.43 |
| Sn/Pb (initial) | 1.06 |
| Sn/Pb (final) | 6.7 |

For both compositions C3 and C4, curing of the silver-filled epoxy compositions with these adducts at 150° C. for 15 minutes resulted in cured adhesives with excellent impact strength and good electrical properties. Formulations cured with YSE-Cure N001 adduct are found to have better properties than those cured with the YSE-Cure B001 adduct curing agent. The best properties were obtained using silver flake SF-80, which is a high surface area and high density silver. Similar to the analysis above, for composition C4 with YSE-Cure N001, using SF-235 silver flakes (manufactured by Technic, Inc., with a tap density of 2.5-4.0 g/cm$^3$, a medium viscosity, and a surface area of 0.6-1.2 m$^2$/g) instead of SF-280 silver flakes yielded an impact measurement of 6 drops, an initial resistance value on a copper surface of 0.4 mΩ, a final resistance value on a copper surface of 2.2 mΩ, an initial resistance value on a tin/lead surface of 2.4 mΩ, and a final resistance value on a tin/lead surface of 11.4 mΩ. Similarly, using SF-299 silver flakes (also manufactured by Technic, Inc., with a tap density of 2.8-4.2 g/cm$^3$, a medium viscosity, and a surface area of 0.3-0.8 m$^2$/g) instead of SF-80 silver flakes yielded an impact measurement of 6 drops, an initial resistance value on a copper surface of 0.3 mΩ, a final resistance value on a copper surface of 0.26 mΩ, an initial resistance value on a tin/lead surface of 1.78 mΩ, and a final resistance value on a tin/lead surface of 4.0 mΩ.

Further, using SF-26LV silver flakes instead of SF-80 silver flakes yielded an impact measurement of 181 drops and very high resistance values. When the weight percentage of SF-26LV was changed from 75% to 79% in the composition, the impact value changed to 45 drops, with an initial copper surface resistance of 0.42 mΩ, a final copper surface resistance of 2.0 mΩ, an initial tin/lead surface resistance of 3.2 mΩ, and a final tin/lead surface resistance of 5.0 mΩ.

Using a 30:70 mixture of SF-26 LV and SF-299 silver flakes instead of SF-80 silver flakes yielded an impact measurement of 43 drops, an initial resistance value on a copper surface of 0.1 mΩ, a final resistance value on a copper surface of 0.1 mΩ, an initial resistance value on a tin/lead surface of 1.8 mΩ, and a final resistance value on a tin/lead surface of 5.3 mΩ. Similarly, using a 50:30:20 mixture of SF-26 LV, SF-299 and SF-450 silver flakes instead of SF-80 silver flakes yielded an impact measurement of 41 drops, an initial resistance value on a copper surface of 0.15 mΩ, a final resistance value on a copper surface of 3.1 mΩ, an initial resistance value on a tin/lead surface of 0.6 mΩ, and a final resistance value on a tin/lead surface of 60 mΩ. SF-450 is also manufactured by Technic, Inc., with a tap density of 1.8-3.0 g/cm$^3$, a high viscosity, and a surface area of 0.6-1.2 m$^2$/g.

As shown above, the conductive adhesives made with high density, low surface area SF-26LV silver flakes provided high impact strength, but the electrical resistance values measured on both the copper and tin/lead surfaces, particularly after aging, were very high, which may be due to the excessive settling of the silver flake SF-26LV in these low viscosity formulations. Mixing two or more different silver flakes has been shown to be effective in overcoming some of the shortcomings of the individual silver flakes.

It is to be understood that the present invention is not limited to the embodiments described above, but encompasses any and all embodiments within the scope of the following claims.

I claim:

1. A high impact strength conductive adhesive, comprising a mixture of:

a bisphenol A-based epoxy resin;

a curing agent comprising a 2,4,8,10-tetraoxaspiro (5,5) undecane-3,9-dipropanamine adduct with (butoxymethyl) oxirane;

flakes of silver; and a secondary epoxy resin, wherein the bisphenol A-based epoxy resin comprises about 8.33 wt % of the mixture, the secondary epoxy resin comprises about 8.33 wt % of the mixture, the curing agent comprises about 8.33 wt % of the mixture, and the balance of the mixture comprises the flakes of silver.

2. The high impact strength conductive adhesive as recited in claim 1, wherein each said silver flake has a tap density of between about 3.2 g/cm$^3$ and about 5.0 g/cm$^3$.

3. The high impact strength conductive adhesive as recited in claim 1, wherein each said silver flake has a surface area of between about 0.4 m$^2$/g and about 0.7 m$^2$/g.

4. A high impact strength conductive adhesive, comprising a mixture of:

a bisphenol A-based epoxy resin;

a curing agent comprising a 2,4,8,10-tetraoxaspiro (5,5) undecane-3,9-dipropanamine adduct with 2-propenenitrile;

flakes of silver; and a secondary epoxy resin, wherein the bisphenol A-based epoxy resin comprises about 8.33 wt % of the mixture, the secondary epoxy resin comprises about 8.33 wt % of the mixture, the curing agent comprises about 8.33 wt % of the mixture, and the balance of the mixture comprises the flakes of silver.

* * * * *